US005579888A

United States Patent [19]

Slyper

[11] Patent Number: 5,579,888

[45] Date of Patent: Dec. 3, 1996

[54] COIN COLLECTION ARRANGEMENTS

[76] Inventor: Colin Slyper, PO Box 3241, Rustenburg, South Africa, 0300

[21] Appl. No.: 386,517

[22] Filed: Feb. 6, 1995

[30] Foreign Application Priority Data

Feb. 7, 1994 [ZA] South Africa ..... 94/0799
Nov. 7, 1994 [ZA] South Africa ..... 94/8751

[51] Int. Cl.[6] ..... G07D 1/00

[52] U.S. Cl. ..... 194/350; 222/558; 453/18

[58] Field of Search ..... 194/202, 350; 453/18, 17, 56, 63; 232/4 D, 15, 16; 222/556, 558; 221/281

[56] References Cited

U.S. PATENT DOCUMENTS

| | | | |
|---|---|---|---|
| 642,161 | 1/1900 | Sargent et al. | 222/558 |
| 2,642,881 | 6/1953 | Buchholz | 453/17 |
| 4,509,531 | 4/1985 | Ward | 128/736 |
| 4,752,274 | 6/1988 | Abe | 453/32 |
| 5,044,483 | 9/1991 | Stefan | 194/350 |
| 5,211,275 | 5/1993 | Halsey et al. | 194/350 |
| 5,386,903 | 2/1995 | Rothschild et al. | 194/350 |

*Primary Examiner*—F. J. Bartuska
*Attorney, Agent, or Firm*—Jacobson, Price, Holman & Stern, PLLC

[57] ABSTRACT

A housing and a collection bin for coins for a coin freed or gambling machine which is demountable from the machine. The bin has a radial and an outer flap with a sloping floor and chute for delivery of collected coins. The security is provided by a key actuated lock or a key pad code released servo motor and a proximity detector can be linked to a centralized computer monitoring system. The housing includes a service duct for cables accessible from a front opening door and a cable chute from the machine to the duct.

5 Claims, 8 Drawing Sheets

FIG. 1
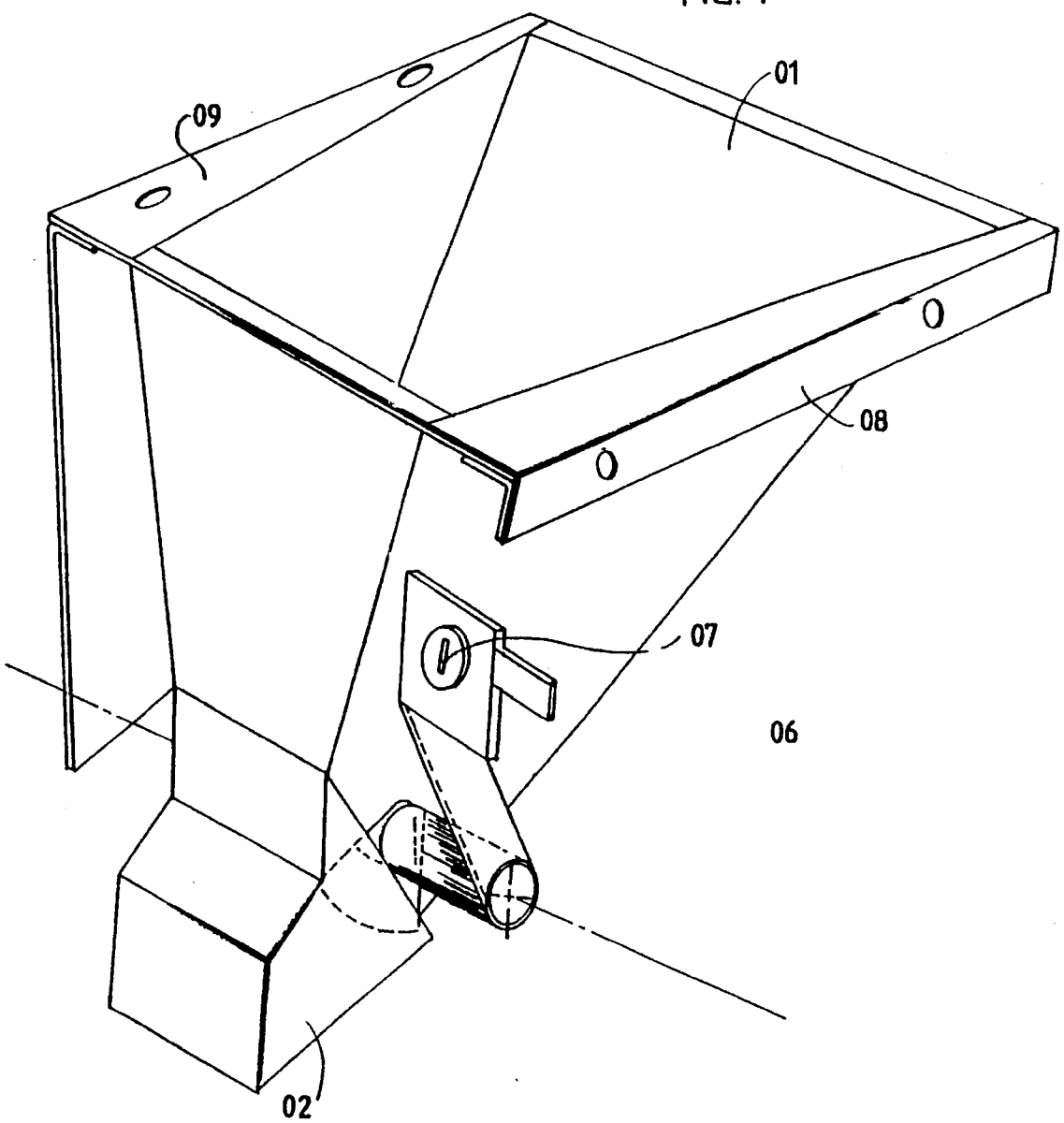
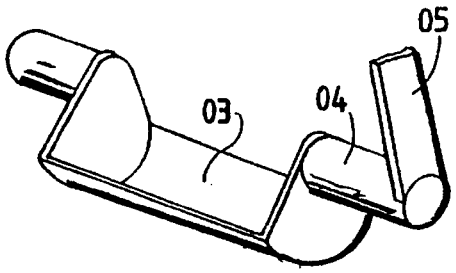
FIG. 1A 19
76
13
1
18
12
5
10
4
6
8
11
7
8a
9
75a
17
2
3
80
77
17
79
32
82
78
81

COIN COLLECTION ARRANGEMENTS

BACKGROUND

This invention relates to devices such as gambling machines, coin freed machines and the like.

Machines of this general kind collect coins, these drop into a bin located in the lower region of the unit from which the coins are periodically collected and carried away in plastic buckets.

DISCUSSION OF THE PRIOR ART

Often the coin bins are rectangular in shape with a front opening door set in the front wall of the bin with the result that it is inconvenient and often uncomfortable to remove the coins manually from the bin. The coins are often located in a dark corner of the bin and sometimes even are missed by the individual. This makes financial controls which are intended to prevent pilfering of not much effectiveness and the effort and tedium of collecting the coins is exacerbated.

There is also a need for the coin collecting door or other means of access for collecting coins to have an acceptable level of security against unauthorised accessing or pilfering.

SUMMARY OF THE INVENTION

Objects of the invention are to enhance the convenience and security of collecting coins and greater ease of operation; a lock mechanism must have key access from outside the box; a complete discharge of coins is to be provided for, if the coin bin overfills the flow of coins must be blocked without overflow and no coins must be lost in a cabinet containing the coin bin; electrical ducting must give easy access to electric cables and there must be smooth passages for fibre-optic cables; generally the device must be robust and durable; control of outflow of coins to a trickle if needed and to shut off flow must be possible.

A broad concept underlying the present invention is the provision of housings for collection bins for coins which are structurally independent from a coin freed or gambling machine to be placed above the housing for the coin bin, this housing having an aperture upon which the machine is to be placed, the aperture adapted to provide a passage for coins from the machine into the bin, the housing has means for retrieval of coins from a front surface from the bin. The top of the bin is adjacent the top of the housing and a foam plastic layer seals between the machine and housing so there is no overflow of coins.

In accordance with a further broad feature of the invention which greatly improves the convenience and accessibility to coins the bin has a sloping floor which slopes downwardly towards an openable door in the front surface of the housing for the bin.

A further preferred feature of the housing for the bin is that, at a lower level, it contains a cable conduit or service duct located close to an openable front door for containing various cables, both of electrical and of information type as required.

Another key feature which is preferred is a cable chute communicating between a cable aperture through which cables from the machine can be led and the service duct.

A further preferred feature is that the bin is provided mounted in the bin housing on slidable racks to enable it conveniently to be slid out if required for servicing. The bin is preferably secured in its position in the bin housing by a series of screws and bolts accessible only from the inside of the housing.

Preferably the control of the chute door at the bottom of the bin from which the coins may issue when the door is released is by means of a lock and separate bolt. The lock will be arranged to enable locking the bolt in position in which case the door at the bottom of the bin chute will not be openable. Once the lock is disengaged in the bolt, however, it will be free to be pulled or otherwise actuated which will then free the bin door to open or actuate it to open to allow the coins in the bin to pour out of the bin. A bucket may be placed underneath to catch the coins. A chute flap may be added to prevent coins pouring out too fast.

Preferably the bin is a steel coin bin and it may this be completely sealed within the base housing of the slot machine or other. This offers superior security and no spillage into the cabinet. By contrast the present methods of coin drop collection from slots machines involves the use of buckets placed under the slot machine in a lockable cupboard fitted with a hinge door. The buckets full of coins are difficult to handle in the confined space of the cupboard. Because of these difficulties operating personnel must move chairs away from the door and bend down to remove the heavy bucket from inside the cupboard. Apart from being both awkward and time consuming this also exposes the personnel to back injury. Furthermore, in the conventional systems, as the slot machine discharges coins into the bucket located in the housing below a certain amount of spillage occurs into the cupboard. The coins often end up in inaccessible corners where they are either left or recovered with time consuming difficulty. Over very busy periods full buckets are replaced with a new empty one, again this results in spillage into the cupboard. In U.S. Pat. No. 5,044,483 a slideable bin with a bottom opening flap is disclosed giving one uncontrolled dump of coins and subject to coin spillage in the housing.

Preferably in accordance with the invention there is used only one moving part namely a radial door secured by the lockable handle. This would provide for long service life reliability and ease of operation. With the use of the invention all that is required is to place a bucket outside the lower housing or any other suitable container outside the housing below the discharge spout of the bin at the front of the cabinet. The mechanism in unlocked and the discharge lever is moved a short distance to produce the coin drop which is accomplished within a few seconds with the minimum of effort by the operation.

In accordance with a preferred embodiment of the invention a lower housing for the coin bin is provided which extends longitudinally, providing for a plurality of bins to be mounted along the length of the housing, each bin to be located underneath one slot machine or similar machines which is a source of coins. In this arrangement the power conduit underneath the bins can run continuously along the full length of the elongated housing.

BRIEF DESCRIPTION OF THE DRAWINGS

This invention will be described further by way of examples with reference to the accompanying drawings in which:

FIG. 1 is a perspective view of a coin bin in accordance with the invention, FIG. 1A is a perspective view of a door in accordance with the present invention.

FIG. 1 shows a fairly simple embodiment of the invention, showing the bin 01 which has a spout 02 at the bottom of the inclined base of the bin. The spout 02 inclines downwards. Coins accumulated in the bin are kept there by the radial door 03. The door 03 is shown in view of FIG. 1A as if removed from the machinery. It is actuated by the torque tube 04 to which is fixed a radial door lever 05 in turn amounted to a lock cam 06 controlled by the lock 07. When the correct key is inserted in the lock 07 the lock cam 06 may be turned so as to coincide with the slot in the front wall of the lower cabinet in which the coin bin is placed. The lock cam is normally behind this front wall therefore preventing the radial door from being opened. Once turned the lock can come opposite a slot which allows the lock cam to be moved in the open direction as indicated on the drawing to therefore open the radial door and allow the coins to cascade out of the spout 02. The bin is bolted in place along brackets 08, for withdrawing the coins a bucket may be placed under the spout.

An improved embodiment is shown in FIGS. 2 and 3 in which the steel bin 1 again has the spout 2 at the bottom of a sloping floor, the spout itself again sloping. However, in this case a front door 3 which is in the form of a hinged flap and pushed open by the coins cascading outwards is provided. This prevents the coin shooting out too far beyond a bucket and also closes visibility into the spout from the front. In this case the control of opening or closing the chute is provided by means of a bar 4 or operating rod of a push/pull type. It has a front portion which can be held by the finger as shown. The rod has a notch 5 in it which will be engaged by the tab 6 of the lock 7 when in a locked condition. This will effectively prevent the rod from being pulled outwards and therefore prevent opening of the chute. A lever 8 has a slotted hole in which a bolt 10 which is fixed to the rod 4 can move so that the moving of the rod 4 results in pivoting of the lever 8. The lever 8 will pivot about a shaft 8A which in turn is fixed to the radial door 9. The floor of the steel bin 1 has an allowance 1A for the pivoting of the radial door 9 in the direction indicated by arrow 9A for opening. The rod 4 slides in a hole in the front panel 18 of the lower cabinet and also in a sleeve 11 which is fixed to the side of the bin 1. A bush 12 is attached to the rear face of the facia to further support the sliding of the rod 4. A bracket 13 allows for the mounting of the bin in a sliding fashion (as can be observed with reference to the description and the drawing of FIG. 5) on suitable surface provided therefore in the lower cabinet. A seal in the form of a sponge 14 is provided at the rear of the bin to make sure that no coins could fall behind the bin. A trim strip 15 which will also be referred to with reference to FIG. 5 runs longitudinally to hold the front wall 18 in position and provide for security of the installation. This is fastened by means of an internally accessible screw 15A. The top surface 16 of the lower cabinet has a hole (not shown) for coins to fall from the gambling machine into the bin 1. The base of the gambling machine or slot machine is shown at 19. This is bolted to the cabinet top by bolts 19A. A lower security bracket 20 is also bolted in place, this time to the base 17 of the lower cabinet by means of a bolt 20A. FIG. 4 shows an optional security device to provide an electrical signal, for example, to a computerised control system and monitoring system to signal whenever the radial door of the bin is open. This device comprises a bracket 21 attached to the side of the radial door while the bracket 22 is attached to the chute. A magnetic switch 23 is mounted on these brackets and wires 24 provide for the relaying of electrical signals from the coin bin 25.

FIG. 5 shows the general arrangement of the bin in a lower cabinet and preferred features of the cabinet in accordance with the invention. The lower cabinet comprises an end wall 31 which establishes the main body of the lower cabinet. A service duct for electrical trunking is provided at 32 being at the lower region of the cabinet and below the bin. This houses electrical trunking 33 which runs longitudinally along the lower cabinet for a plurality of bins as required, and as is shown further in FIG. 6. A kick rail 34 is provided. The low securing bracket 35 of the bin and front wall 38 arrangement is shown with a bolt and hole 36 for bolting down of this bracket. The bin 37 again has a chute which has the flap front door 39 and screws 40 allow for the screwing of the front wall 38 into uprights on the sidewalls of the lower cabinet. A top baton or trim 41 is fixed to the front wall 38, again extending longitudinally as required and this is bolted from the inside by bolts 42 and by screws 42A. The lower cabinet in this case houses the bin 37 only in part of its width and in the remaining part it has a cupboard door 43 which is lockable for convenience. A dividing bulk head 44 is provided. This support rails 45 are provided upon which the side rails 45A of the bin 37 can slide to conveniently allow removal of the bin when required. A front cover 46 for the service duct is provided as well as a top wall 47. The top wall 47 has an opening 47A, the dimensions and location whereof can be varied as required to receive the coins dropping down into the bin from the slot or other gambling machine which is bolted on top of the lower cabinet. As will be seen other features of the bin are as described with reference to FIGS. 2 and 3.

FIG. 6 shows how a plurality of bins can be provided in a plurality of lower cabinets 51, 52, 53 and 54 and so on as required. Each lower cabinet of which only the bin 55 in the cabinet 51 is shown in broken lines. The front door flap 56, 57, 58 and 59 respectively and the side covers, the cupboards with their cupboard doors 60, 61, 62 and 63 respectively. A bucket 64 is shown by way of example where it is placed to catch the coins where they are discharged from the chute. This view also shows the handle 65 of the bolt in the case of the bin 55 as well as the lock 66. The view also shows the covers 67, 68, 69 and 70 for access to the electrical trunking, it furthermore shows the facia trim strips 71, 72, 73 and 74 shown in this example as separate strips in order that individual bins can be conveniently removed.

Thus this system is seen to be modular in concept and can be connected together in either a free standing configuration or fitted against walls or pillars, etc. The system thus consists of a cabinet designed to hold a coin bin and has provision for electrical conduits and a utility storage cupboard. Access to the bolts which hold the front panels behind which the bins are located in only possible for security personnel who have keys to the locks to the utility cupboard. Once all the securing bolts and screws have been removed the entire coin bin with the its operating mechanism, the front facia panel and the top baton can be pulled out from the front of the cabinet for servicing if this is required. The advantage of this is that the slot machine and the top of the cabinet are not disturbed in the event of maintenance work being required to the bin or lock.

Figure 7:
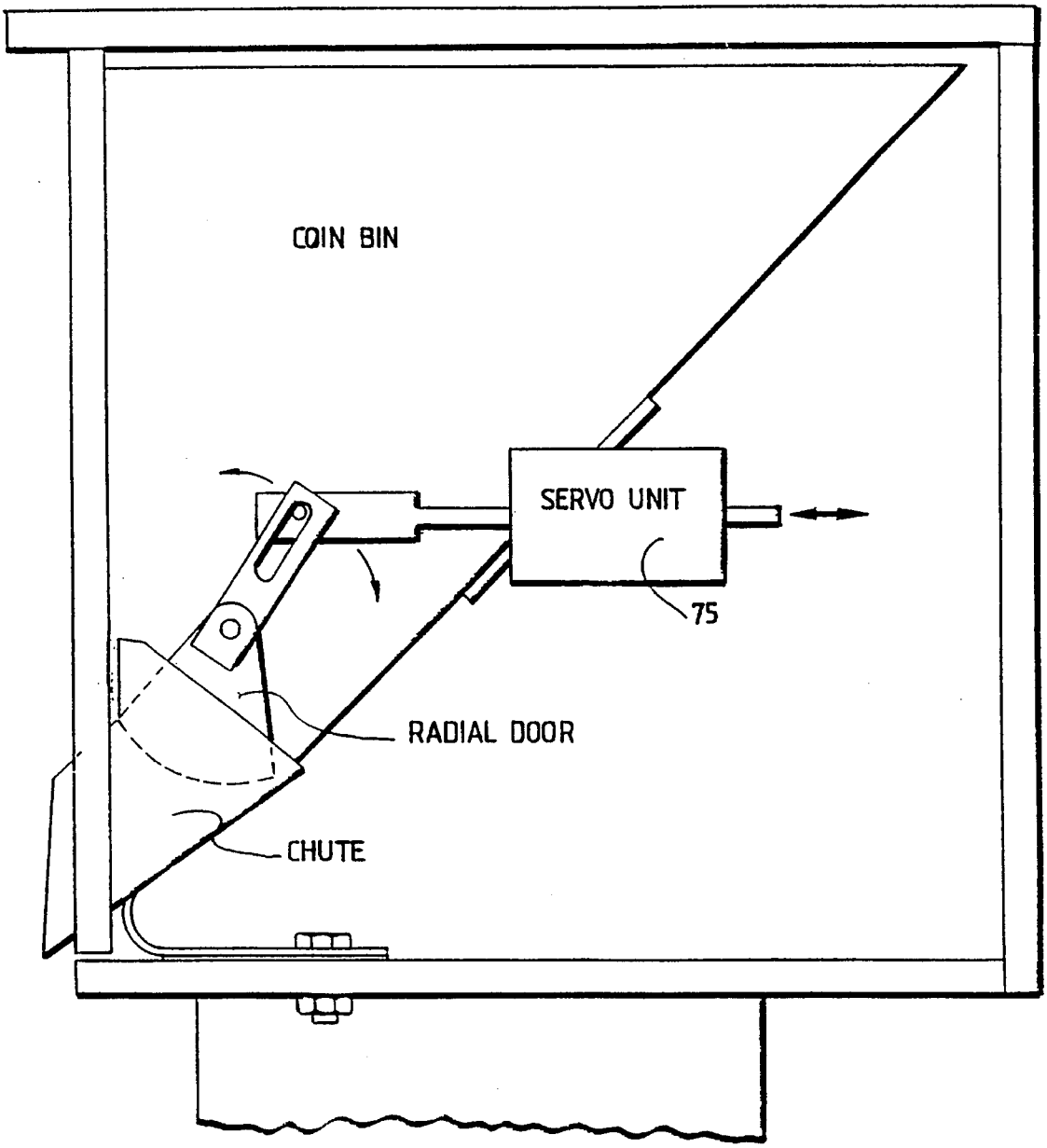
FIG. 7 is a side view of a remote actuated mechanism for release of the radial door of the chute.

FIG. 7 shows means 75 for operation of radial door using an electrical, pneumatic or hydraulic servo motor. Allowing remote control of the coin drop. Advantages of the system are:

1. No protruding mechanism on the front of the cabinet.
2. Eliminates locks and keys for each unit. Remote controller is locked in one separate compartment to service entire bank.

A key pad could be used to input a secret code to unlock the servo unit 75.

Figure 2:
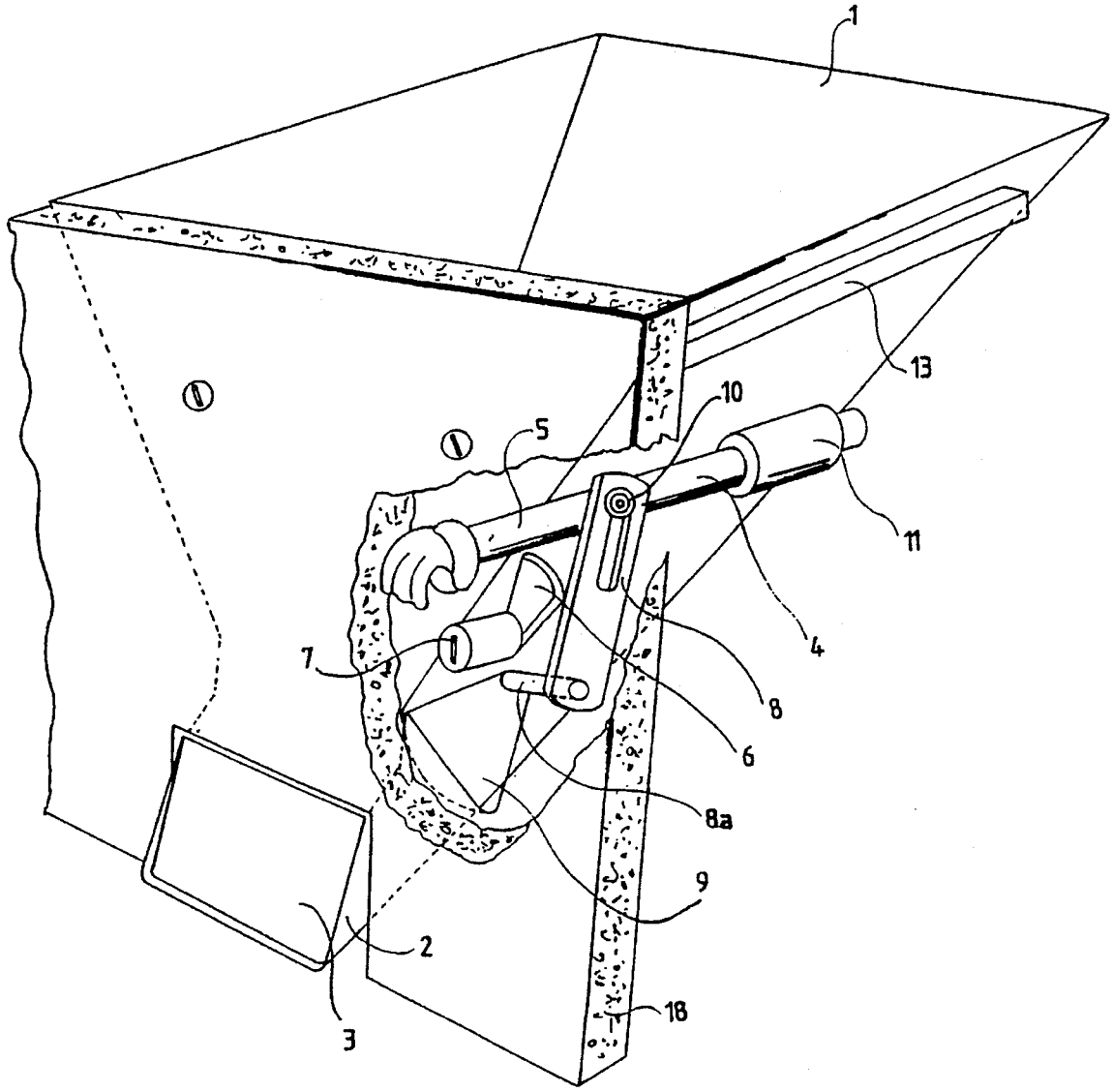
FIG. 2 is a perspective view of another coin bin in accordance with the invention.
Figure 3:
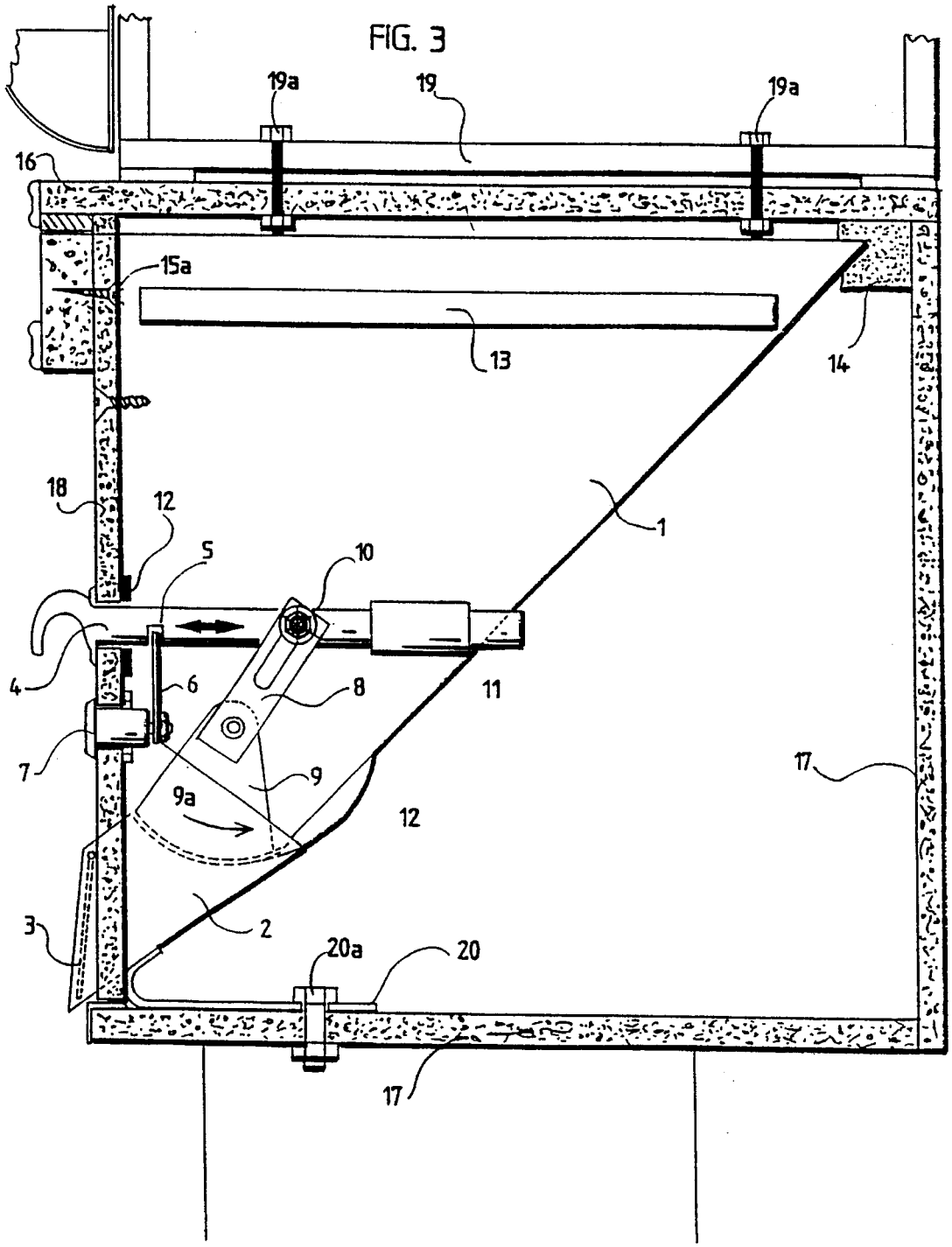
FIG. 3 is a side cross sectional elevation of the coin bin shown in FIG. 2 located in a lower housing in accordance with the invention.
Figure 4:
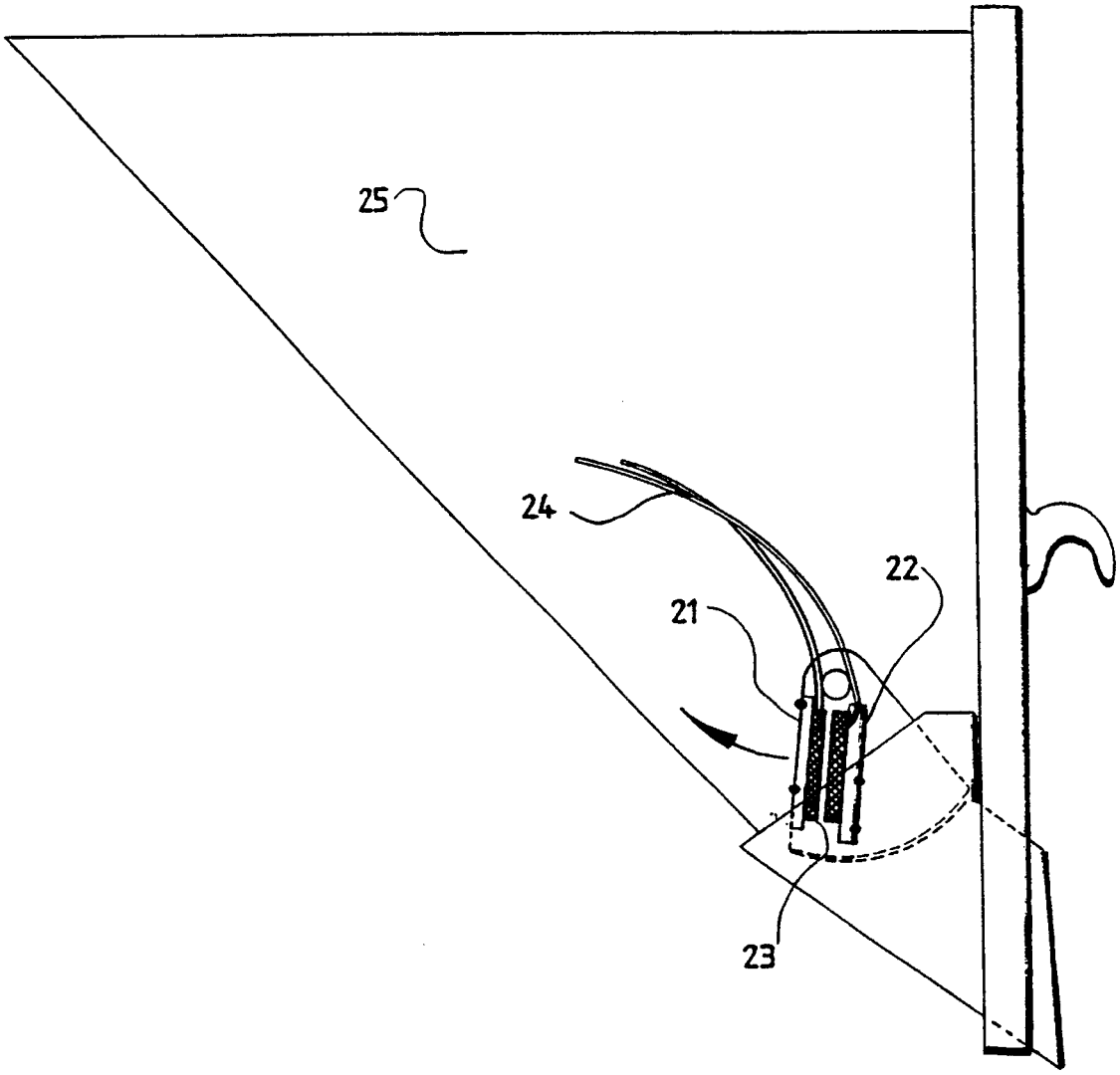
FIG. 4 is a side elevation of the bin showing a preferred detail.
Figure 5:
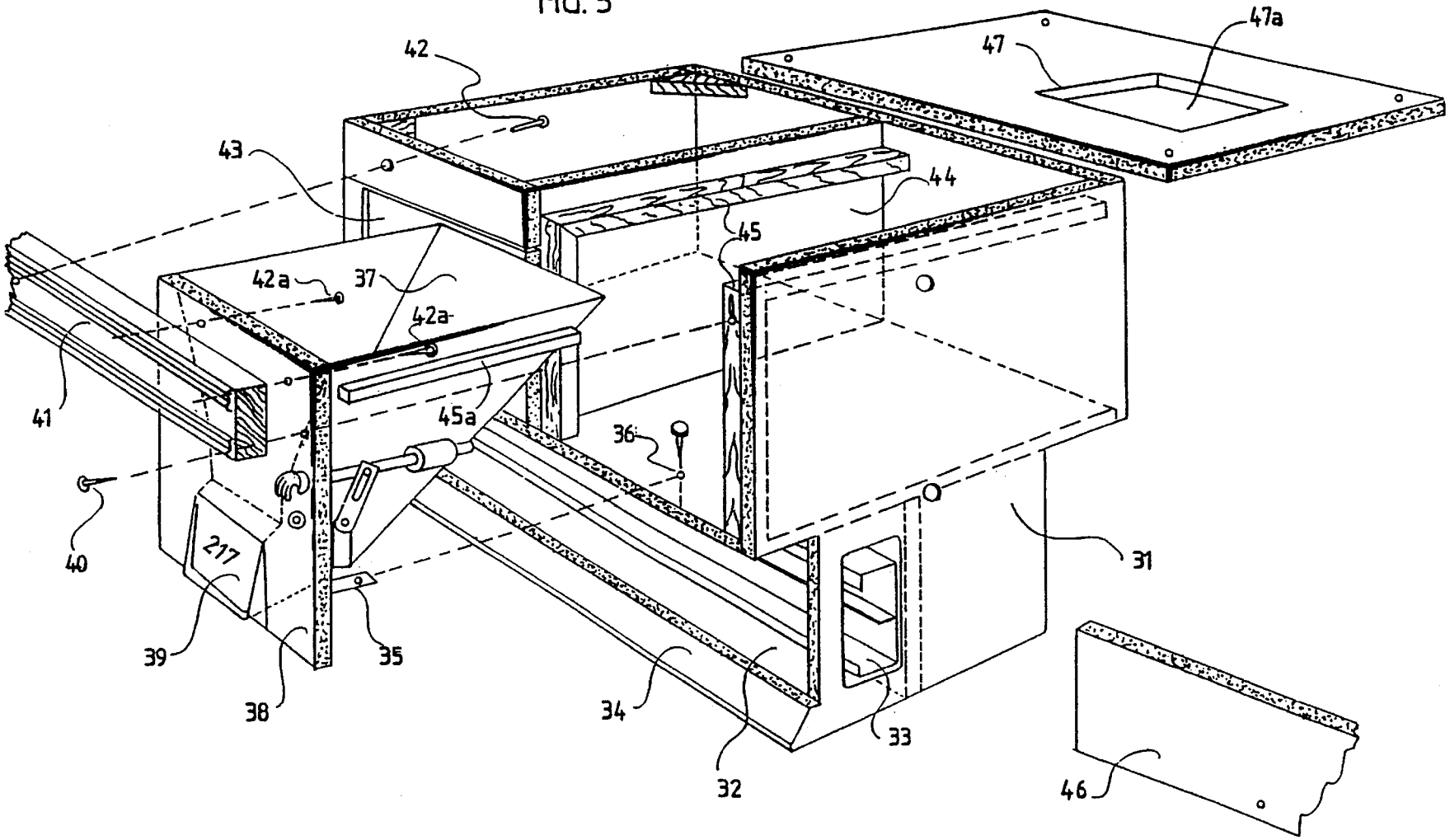
FIG. 5 is a perspective view showing the general arrangement of a coin bin, a lower housing.
Figure 6:
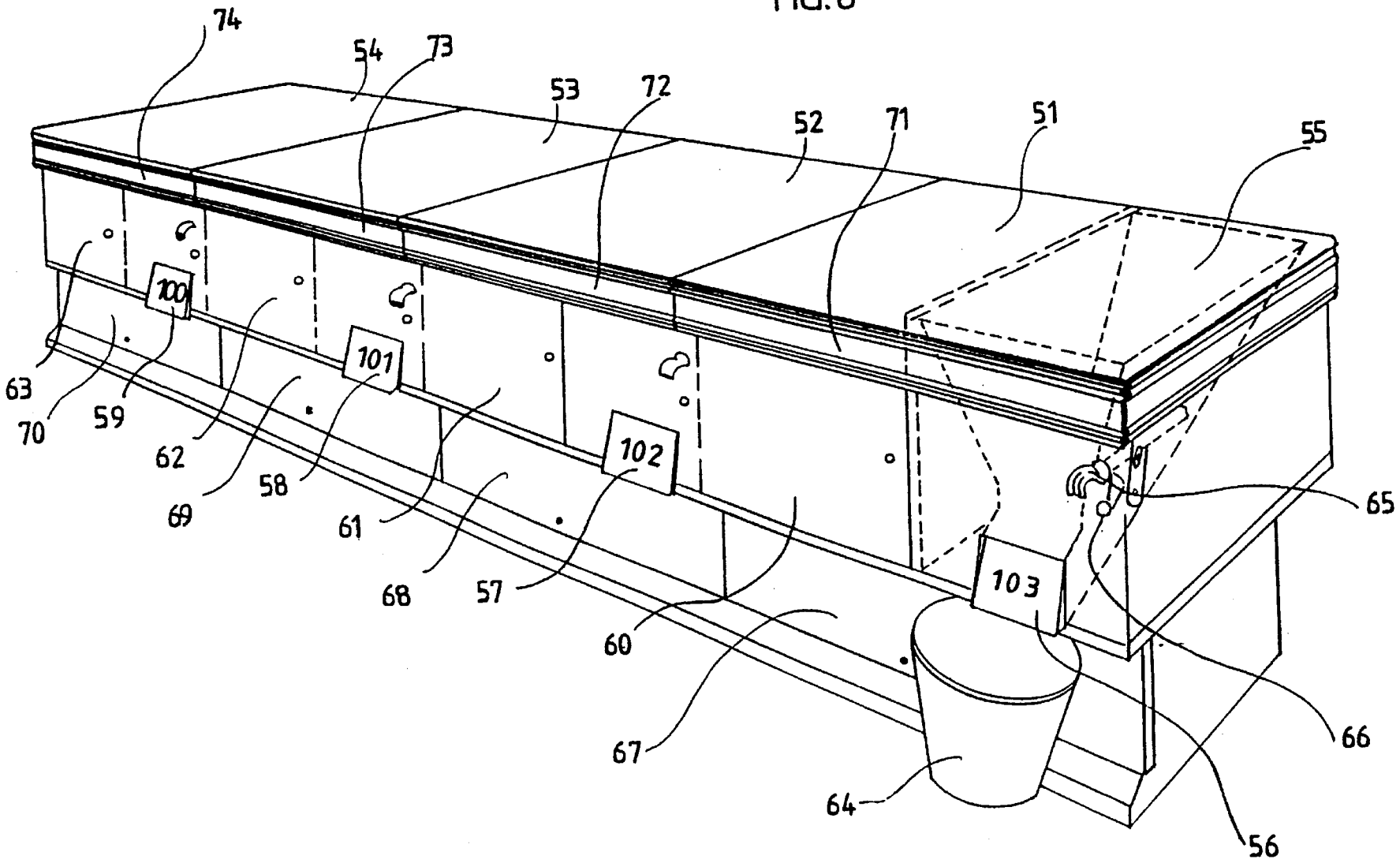
FIG. 6 is a perspective view showing an elongate installation of a plurality of housings and bins, in accordance with the invention.
Figure 8:
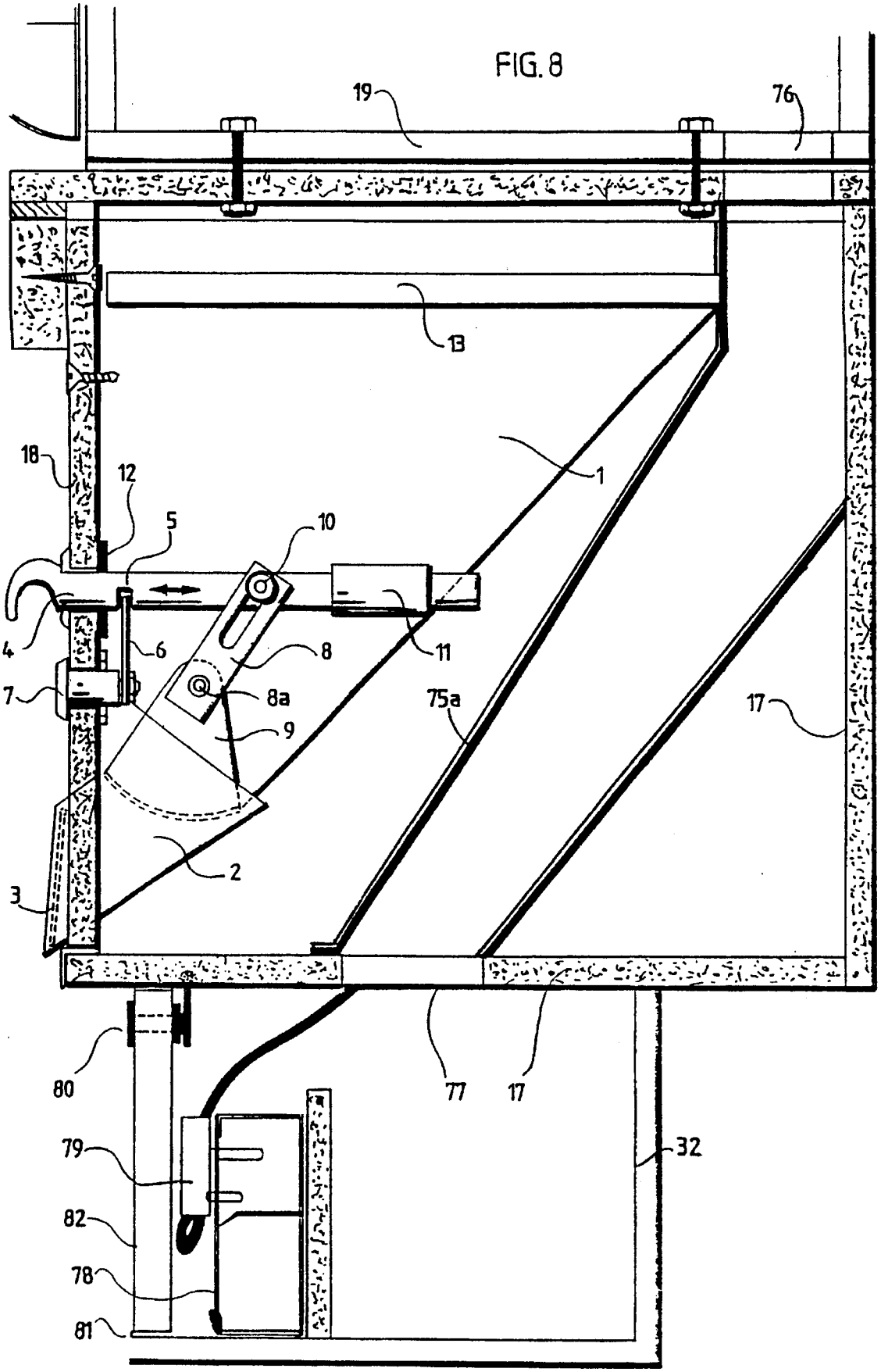
FIG. 8 is a side cross sectional elevation showing an embodiment with a cable chute leading to a service duct.

FIG. 8 shows a cable chute 75*a* which leads from a cable aperture 76 for cables from the gambling machine such as a "one armed bandit", leading to the service duct 32 via a hole 77 in the bottom of the cabinet 17. The width of the cable chute 75*a* is as wide as the mechanism compartment and large enough for power and electronic cables and plugs to be passed down to the power trunking below. There is an existing hole in the slot machine for the power cable and an elongated hole in the top of the slot machine's base. A plug socket box 78 is shown in the service duct 32 and a plug 79 in it, supplying power to the machine. A catch 80 allows closing of the front wall 82 of the service duct which can hinge on hinge 81. Other parts are shown with the same reference numerals used in FIGS. 2 to 3.

LIST OF COMPONENTS

FIG. 1

01—Coin bin
02—Spout
03—Radial door
04—Torque tube
05—Radial door lever
06—Lock cam
07—Lock
08—Mounting flanges
09—Mounting flanges

FIGS. 2–3

1—Steel coin bin
2—Chute
3—Hinged flap (closes mouth of chute and controls flow of coins)
4—Push/pull operating rod
5—Recess for lock tongue
6—Lock tab
7—Lock
8—Radial door lever (slotted)
8*a*—Radial door shaft
9—Radial door
10—Connecting bolt (push/pull rod to radial door)
11—Bush (attached to bin)
12—Bush (attached to front facia panel)
13—Support rail (one to each side)
14—Foam plastic seal
15—Facia trim and securing baton (see cabinet detail)
16—Top of cabinet
17—Cabinet body
18—Front facia attached to coin bin
19—Base of slot machine, bolted to cabinet top
20—Lower securing bracket

FIG. 4

21—Bracket attached to side of radial door
22—Bracket attached to chute
23—Magnetic switch (attached to brackets with mirror tape)
24—Wires
25—Coin bin

FIG. 5

31—Main body
32—Service duct for electrical trunking
33—Electrical trunking
34—Kickrail
35—Lower securing bracket
36—Lower bracket bolt hole
37—Coin bin
38—Front facia panel fixed to coin bin
39—Chute hinged flap
40—R.H.S. facia securing screw
41—Top batten and trim fixed to facia panel and coin bin
42—Top batten securing screw (inside l.h.s. cupboard)
43—Left side cupboard door
44—Dividing bulkhead
45—Bin support rails
46—Service duct front cover
47—Top of cabinet

FIG. 6

51–54—Cabinets
55—Coin bin
56–59—Hinged flaps on discharge spouts
60–63—Doors for service cupboards
64—Bucket
65—Handle accessible for control rod for radial door
66—Lock
67–70—Removable covers for access to electrical trunking
71–74—Trim strips

FIG. 7

75—Servo unit

FIG. 8

75*a*—Cable chute
76—Cable aperture
77—Hole
78—Socket box

79—Plug

80—Catch

81—Hinge

82—Front wall

I claim:

1. A housing for a collection bin for coins, upon which housing a coin freed or gambling machine is to be placed, the housing having a top surface with an aperture over which the machine is to be placed, the aperture adapted to provide a passage for coins from the machine into the bin, the housing having a front surface with means for retrieval of coins from the bin, in which the housing contains a horizontal and transversely extending cable conduit service duct located close to an openable front door located below the front surface and close to the duct, the service duct being adapted for containing various cables, both of electrical and of information type as required.

2. A housing as claimed in claim 1, in which the housing further comprises an aperture for cables from the machine near the rear of the top surface and a cable chute communicating between the aperture for cables from the machine and the service duct.

3. A housing for a collection bin for coins, upon which housing a coin freed or gambling machine is to be placed, the housing having an aperture over which the machine is to be placed, the aperture adapted to provide a passage for coins from the machine into the bin, the housing having a front surface and rails on which the bin and front surface are mounted, slidable outwardly of the housing, wherein the bin has a sloping floor which slopes downwardly towards a chute portion of the bin having an openable door, with security means adapted to provide control over the opening of the openable door, wherein the openable door is a radial door rotatable on a shaft between open and closed positions, the door having the shape of a part of a cylinder the axis of which is concentric with the shaft, and wherein the security means is a key operated lock mounted on a radial arm fixed on the shaft, the lock having a catch adapted to engage with the front surface of the housing.

4. A housing as claimed in claim 3, in which the security means comprises an operating rod which is connected to a lever which is fixed on the shaft, the operating rod having a handle projecting to the outside of the front surface of the housing to be manually actuable when the lock is unlocked.

5. A housing as claimed in claim 3, in which the security means comprises an operating rod which is connected to a lever which is fixed on the shaft, an electro-mechanical servo unit being connected to the operating rod, with a key pad actuated code means adapted to control operation of the servo unit.

* * * * *